US008444724B2

(12) United States Patent
Douglas et al.

(10) Patent No.: US 8,444,724 B2
(45) Date of Patent: May 21, 2013

(54) UPRIGHT GASIFIER

(75) Inventors: Steven L. Douglas, Terre Haute, IN (US); Ronald W. Herbanek, Sugar Land, TX (US); David L. Breton, Houston, TX (US); Steven E. Chichester, Terre Haute, IN (US)

(73) Assignee: Phillips 66 Company, Houston, TX (US)

( * ) Notice: Subject to any disclaimer, the term of this patent is extended or adjusted under 35 U.S.C. 154(b) by 0 days.

(21) Appl. No.: 13/485,583

(22) Filed: May 31, 2012

(65) Prior Publication Data

US 2012/0233921 A1 Sep. 20, 2012

Related U.S. Application Data

(62) Division of application No. 11/834,751, filed on Aug. 7, 2007, now Pat. No. 8,211,191.

(51) Int. Cl.

| | |
|---|---|
| ***B01J 7/00*** | (2006.01) |
| ***B01J 8/00*** | (2006.01) |
| ***C01B 3/36*** | (2006.01) |
| ***C01B 6/24*** | (2006.01) |
| ***C01B 3/02*** | (2006.01) |
| ***C10J 3/00*** | (2006.01) |

(52) U.S. Cl.

USPC ..... 48/197 R; 48/61; 48/77; 48/210; 422/625; 423/644; 423/648.1

(58) Field of Classification Search

USPC ..... 48/61

See application file for complete search history.

(56) References Cited

U.S. PATENT DOCUMENTS

| | | | | | |
|---|---|---|---|---|---|
| 901,232 | A | * | 10/1908 | Eldred | 48/203 |
| 3,920,417 | A | * | 11/1975 | Fernandes | 48/197 R |
| 4,022,591 | A | * | 5/1977 | Staudinger | 48/76 |
| 4,069,024 | A | * | 1/1978 | Fernandes | 48/197 R |
| 4,137,051 | A | * | 1/1979 | Godwin | 48/66 |
| 4,248,604 | A | * | 2/1981 | Woldy et al. | 48/197 R |
| 4,315,758 | A | * | 2/1982 | Patel et al. | 48/197 R |
| 4,436,531 | A | * | 3/1984 | Estabrook et al. | 48/197 R |
| 4,872,886 | A | * | 10/1989 | Henley et al. | 48/197 R |
| 5,069,685 | A | * | 12/1991 | Bissett et al. | 48/77 |
| 5,078,758 | A | * | 1/1992 | Maller et al. | 95/211 |
| 5,327,726 | A | * | 7/1994 | Daman et al. | 60/648 |
| 5,578,092 | A | * | 11/1996 | Collin | 44/620 |
| 5,725,615 | A | * | 3/1998 | Morihara et al. | 48/77 |
| 6,032,456 | A | * | 3/2000 | Easom et al. | 60/793 |
| 7,090,707 | B1 | * | 8/2006 | Barot | 48/113 |

* cited by examiner

*Primary Examiner* — Matthew Merkling
(74) *Attorney, Agent, or Firm* — Phillips 66 Company

(57) ABSTRACT

A generally upright reactor system for gasifying a feedstock. The reactor system generally includes a main body, at least two inlet projections extending outwardly from the main body, and at least one inlet positioned on each of the inlet projections. Each of the inlets is operable to discharge the feedstock into the reaction zone.

13 Claims, 5 Drawing Sheets

UPRIGHT GASIFIER

CROSS-REFERENCE TO RELATED APPLICATIONS

This application is a divisional application that claims benefit under 35 USC §120 to U.S. application Ser. No. 11/846,238, filed Aug. 7, 2007, entitled "UPRIGHT GASIFIER". This application is incorporated herein in its entirety.

BACKGROUND OF THE INVENTION

1. Field of the Invention

The present invention relates generally to methods and apparatuses for gasifying feedstocks. Particularly, various embodiments of the present invention provide gasification reactors that present generally upright configurations.

2. Description of the Related Art

Gasification reactors are often employed to convert generally solid feedstocks into gaseous products. For example, gasification reactors may gasify carbonaceous feedstocks, such as coal and/or petroleum coke, to produce desirable gaseous products such as hydrogen. Gasification reactors must be constructed to withstand the significant pressures and temperatures required to gasify solid feedstocks. Unfortunately, gasification reactors often utilize complex geometric configurations and require excessive maintenance.

SUMMARY

In one embodiment of the present invention, there is provided a two-stage gasification reactor system for gasifying a feedstock. The reactor system generally comprises a first stage reactor section and a second stage reactor section. The first stage reactor section generally comprises a main body and at least two inlets operable to discharge the feedstock into a first reaction zone. The first stage reactor section presents a plurality of inner surfaces cooperatively defining the first reaction zone, with at least about 50 percent of the total area of the inner surfaces having an upright orientation. The second stage reactor section is positioned generally above the first stage reactor section and defines a second reaction zone.

In another embodiment of the present invention, there is provided a reactor system for gasifying a feedstock. The reactor system generally includes a vertically elongated main body, a pair of inlet projections extending outwardly from generally opposite sides of the main body. The main body and inlet projections cooperatively define a reaction zone. At least one inlet is positioned on each of the inlet projections. Each of the inlets is operable to discharge the feedstock into the reaction zone. The maximum outside diameter of the main body is at least about 25 percent greater than the maximum outside diameter of the inlet projections.

In another embodiment of the present invention, there is provided a two-stage gasification reactor system for gasifying a feedstock. The reactor system generally comprises a first stage reactor section, a second stage reactor section, and a throat section. The first stage reactor section includes a plurality of inner surfaces cooperatively defining a first reaction zone, wherein at least about 50 percent of the total area of the inner surfaces has substantially vertical orientation. The first stage reactor system further includes a main body presenting a body portion of the inner surfaces, a pair of inlet projections extending outwardly from generally opposite sides of the main body. The inlet projections present an inlet portion of the inner surfaces. At least one inlet is positioned on each of the inlet projections. Each of the inlets is operable to discharge the feedstock into the first reaction zone. Less than about 50 percent of the total volume of the first reaction zone is defined within the inlet projections and the maximum outside diameter of the main body is at least about 25 percent greater than the maximum outside diameter of the inlet projections. The second stage reactor section is positioned generally above the first stage reactor section and defines a second reaction zone. The throat section provides fluid communication between the first and second reactor sections and defines an upward flow passageway having an open upward flow area that is at least about 50 percent less than the maximum open upward flow area of the first and second reaction zones.

In another embodiment of the present invention, there is provided a method for gasifying a carbonaceous feedstock. The method generally comprises: (a) at least partly combusting the feedstock in a first reaction zone to thereby produce a first reaction product, wherein the first reaction zone is cooperatively defined by a plurality of inner surfaces, wherein at least about 50 percent of the total area of the inner surfaces has an upright orientation; and (b) further reacting at least a portion of the first combustion product in a second reaction zone located generally above the first reaction zone to thereby produce a second reaction product.

In another embodiment of the present invention, there is provided a method for gasifying a carbonaceous feedstock. The method generally comprises at least partly combusting the feedstock in a reaction zone of a gasification reactor to thereby produce a reaction product. The reactor comprises a main body and a pair of inlet projections extending outwardly from generally opposite sides of the main body. The reactor further comprises a pair of generally opposed inlets located proximate the outer ends of the inlet projections. The maximum outside diameter of the main body is at least about 25 percent greater than the maximum outside diameter of said inlet projections.

BRIEF DESCRIPTION OF THE DRAWING FIGURES

Embodiments of the present invention are described in detail below with reference to the attached drawing figures, wherein.

DETAILED DESCRIPTION

The following detailed description of various embodiments of the invention references the accompanying drawings which illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

Figure 1:
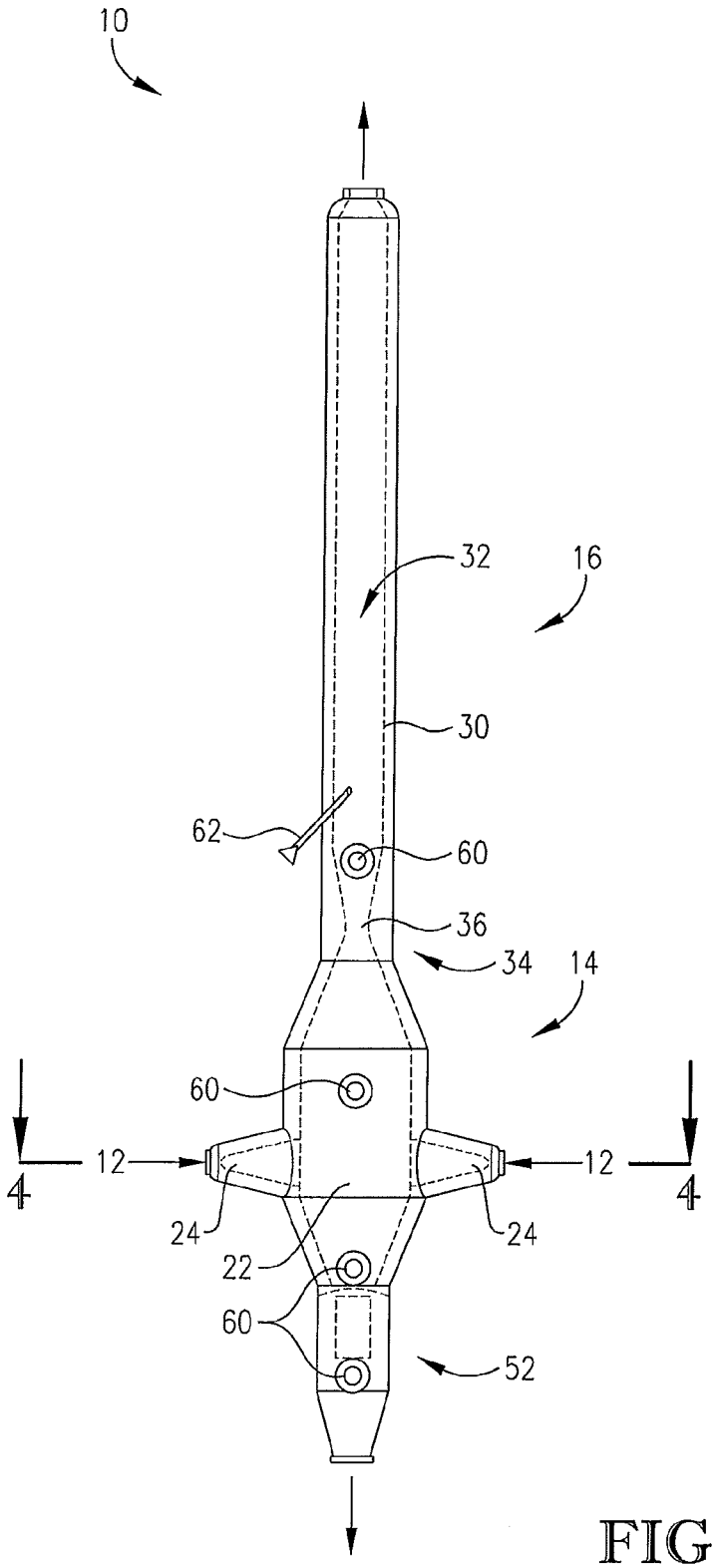
FIG. 1 is an environmental view of a two-stage gasification reactor configured in accordance with various embodiments of the present invention.

Referring initially to FIG. 1, various embodiments of the present invention provide a gasification reactor system 10 operable to at least partially gasify a feedstock 12 (e.g., coal or petroleum coke). In some embodiments, as illustrated in FIG. 1, the reactor system 10 may include a first stage reactor section 14 and a second stage reactor section 16 to present a two-stage configuration. However, the reactor system 10 may present a single stage configuration including only the first stage reactor section 14 in some embodiments.

Figure 2:
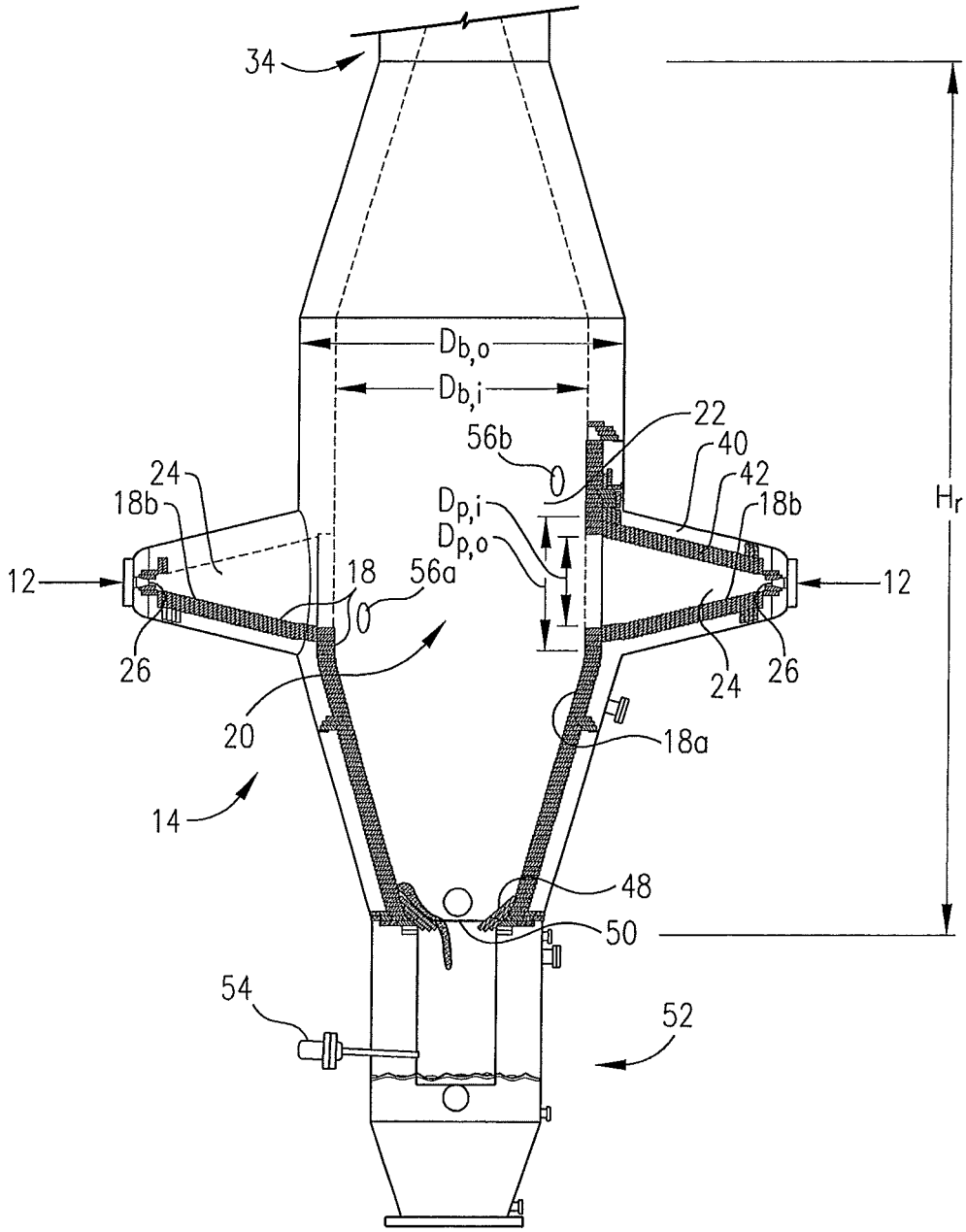
FIG. 2 is a sectional view of a first stage reactor section of the gasification reactor of FIG. 1.

As perhaps best illustrated in FIG. 2, the first stage reactor section 14 can present a plurality of first inner surfaces 18 which cooperatively define a first reaction zone 20 in which the feedstock 12 can be at least partially gasified. The first stage reactor section 14 can include a main body 22 that presents a body portion 18*a* of the first inner surfaces 18 and a pair of inlet projections 24 that present an inlet portion 18*b* of the first inner surfaces 18. At least one inlet 26 can be positioned on each of the inlet projections 24, with each inlet 26 being operable to discharge the feedstock 12 into the first reaction zone 20. In one embodiment, the inlet projections 24 are located as substantially the same elevation.

The first inner surfaces 18 can be oriented in any configuration to define the first reaction zone 20. However, in various embodiments, at least about 50 percent, at least about 75 percent, at least about 90 percent, or at least 95 percent of the total area of the first inner surfaces 18 has an upright orientation or a substantially vertical orientation. "Upright orientation," as utilized herein, refers to surface orientations that have a slope of less than 45 degrees from vertical. In some embodiments, less than about 10 percent, less than about 4 percent, or less than 2 percent of the total area of the first inner surfaces 18 has a downwardly facing orientation and/or an upwardly facing orientation. "Downwardly facing orientation," as utilized herein, refers to surfaces having a normal vector that extends at an angle greater than 45 degrees below horizontal. "Upwardly facing orientation," as utilized herein, refers to surfaces having a normal vector that extends at an angle greater than 45 degrees above horizontal.

As is discussed in more detail below, the upright orientation of at least some of the first inner surfaces 18 may reduce the maintenance required by the reactor system 10. For example, minimizing surfaces with downwardly facing orientations may reduce installation costs for various reactor system 10 components, while minimizing surfaces with upwardly facing orientations may reduce the build-up of slag and other gasification byproducts within the first stage reactor section 14.

The overall shape of the first stage reactor section 14 may also facilitate more efficient operation of the reactor system 10 and may reduce maintenance and repair. For example, as depicted in FIG. 2, in some embodiments, the maximum outside diameter of main body 22 ($D_{b,o}$) can be at least about 25 percent, at least about 50 percent, or at least 75 percent greater than the maximum outside diameter of inlet projections 24 ($D_{p,o}$). Such a configuration may limit the length over which the main body 22 and inlet projections 24 must be joined by welding or fastening elements, thereby increasing the internal pressure which can be withstood by the reactor system 10.

As depicted in FIG. 2, in some embodiments, the maximum inside diameter of main body 22 ($D_{b,i}$) (measured as the maximum horizontal distance between the body portion 18*a* of the first inner surfaces 18) can be at least about 30 percent, in the range of from about 40 to about 80 percent, or in the range of from 45 to 70 percent greater than the horizontal distance between the generally opposed inlets 26 of the inlet projections 24. In some embodiments, the main body 22 is configured such that the ratio of the maximum height of the first reaction zone 20 ($H_r$) to the maximum width of the first reaction zone 20 (typically measured as the horizontal distance between the opposed inlets 26) is in the range of from 1:1 to about 5:1, about 1.25:1 to about 4:1, or 1.5:1 to 3:1. In certain embodiments, the maximum outside diameter of the main body 22 ($D_{b,o}$) and/or the maximum inside diameter of main body 22 ($D_{b,i}$) can be in the range of from about 4 to about 40 feet, about 8 to about 30 feet, or 10 to 25 feet. Further, the maximum height of first reaction zone 20 ($H_r$) can be in the range of from about 10 to about 100 feet, about 20 to about 80 feet, or 40 to 60 feet.

Figure 4:
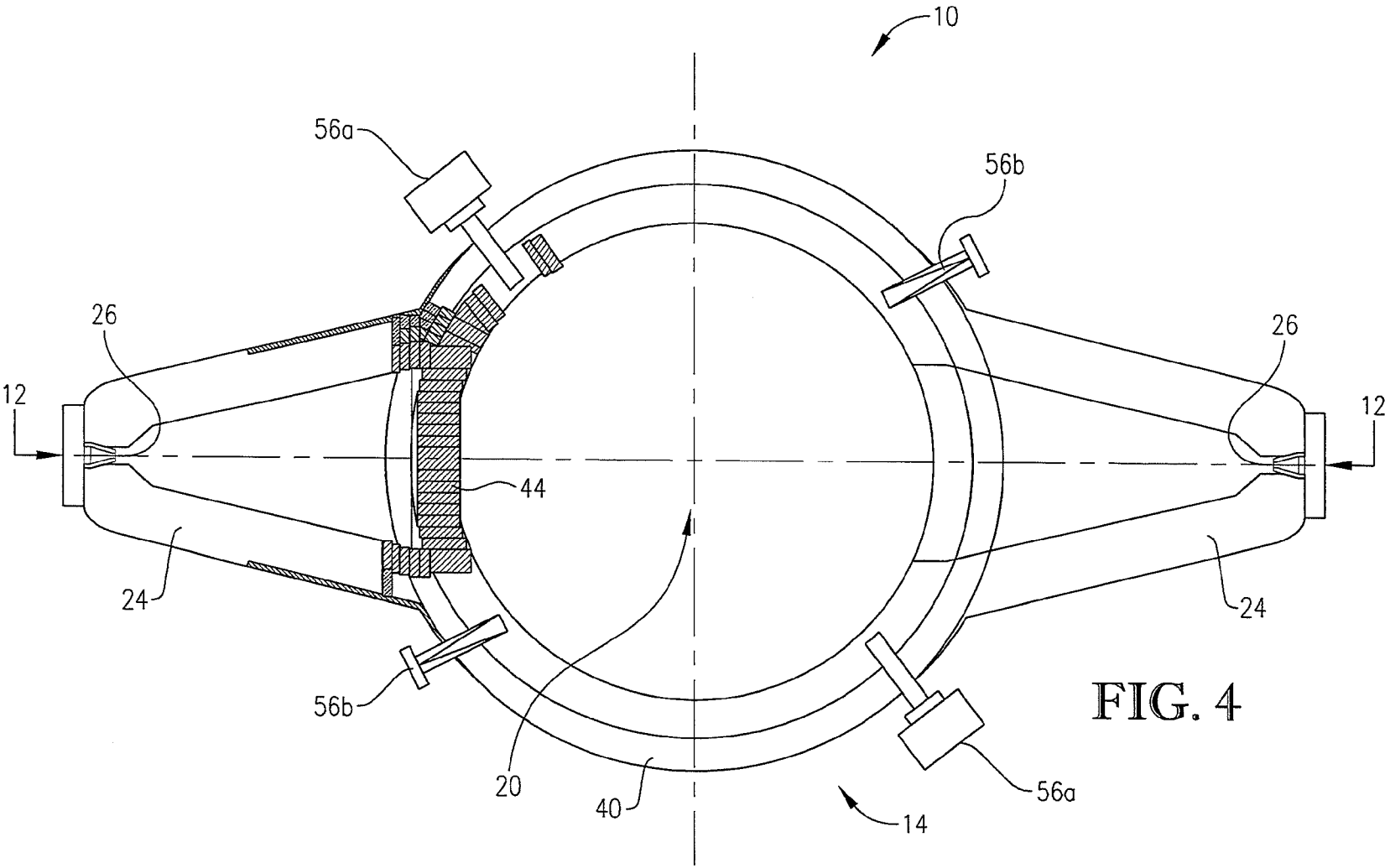
FIG. 4 is a cross section of the gasification reactor taken along reference line 4-4 of FIG. 1.

The inlet projections 24 can extend outwardly from the main body 22 to enable the feedstock 12 to be provided by the inlets 26 to the first reaction zone 20. In some embodiments, the inlet projections 24 may be generally opposed from each other as is illustrated in FIGS. 1, 2, and 4. Thus, the inlet projections 24 may extend outwardly from generally opposite sides of the main body 22.

The inlet projections 24 may take any shape or form operable to retain at least one of the inlets 26 and direct feedstock 12 to the first reaction zone 20. In some embodiments, each of the inlet projections 24 can present generally similar dimensions, with each having a proximal end 24*a* coupled to the main body 22 and a distal end 24*b* spaced outwardly from the main body 22. One of the inlets 26 may be located proximate the distal end 24*b* of each of the inlet projections 24. In some embodiments, each inlet projection 24 can be configured generally in the shape of a frustum. In some embodiments, each inlet projection 24 can have a maximum outside diameter ($D_{p,o}$) and/or a maximum inside diameter ($D_{p,i}$) in the range of from about 2 to about 25 feet, about 4 to about 15 feet, or 6 to 12 feet. In some embodiments, the horizontal distance between the inlets 26 of the oppositely extending projections 24 is in the range of from about 10 to about 100 feet, about 15 to about 75 feet, or 20 to 45 feet.

In some embodiments, less than about 50 percent, less than about 25 percent, or less than 10 percent of the total volume of the first reaction zone 20 can be defined within the inlet projections 24, while greater than about 50 percent, greater than about 75 percent, or greater than 90 percent of the total volume of the first reaction zone 20 can be defined within the main body 22.

Figure 3:
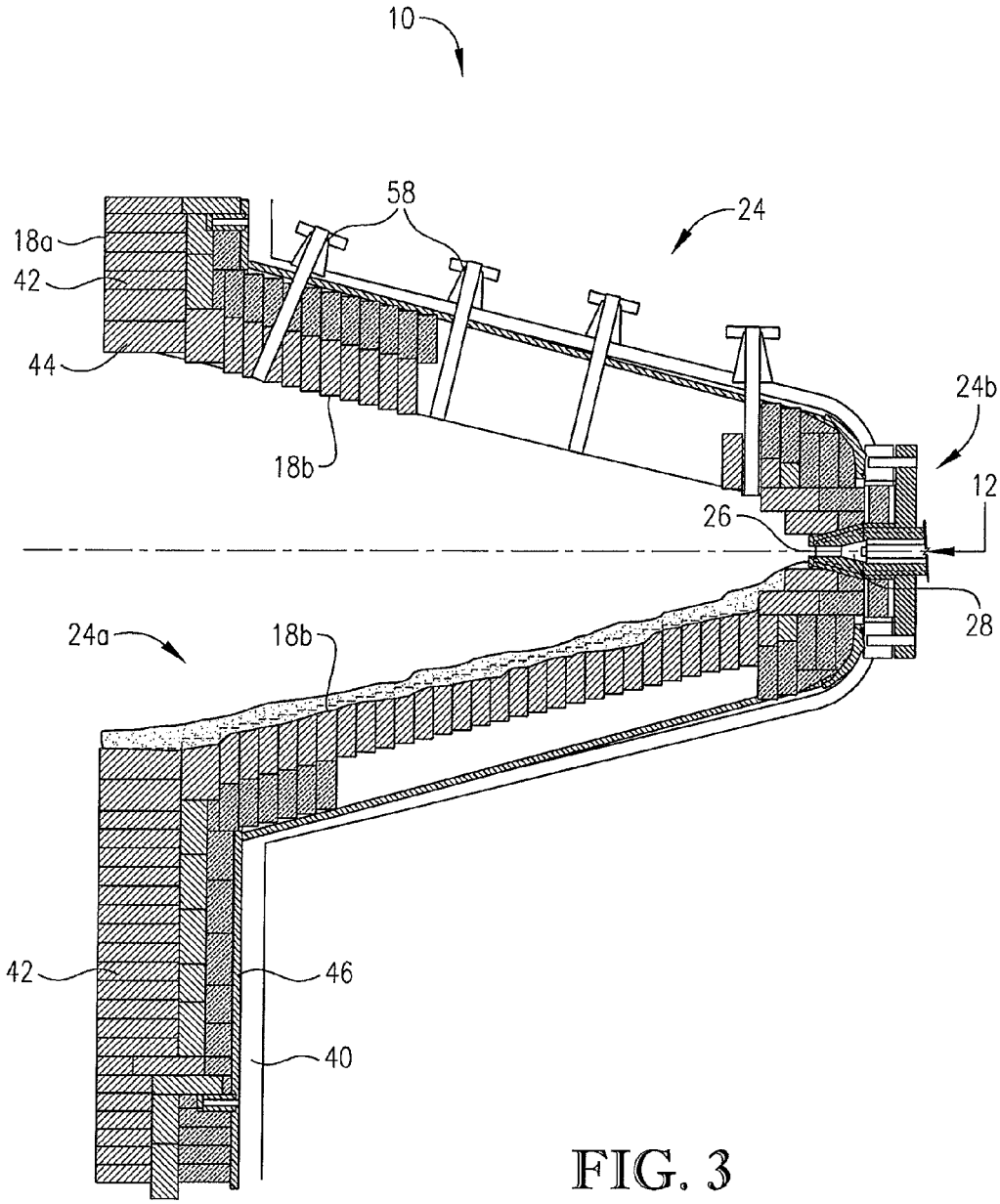
FIG. 3 is an enlarged sectional view showing portions of the first stage reactor section of FIG. 2 in more detail.

Referring now to FIGS. 2-4, the inlets 26 provide feedstock 12 from an external source to the reactor system 10, and more specifically, to the first reaction zone 20. The inlets 26 can be positioned such that a minimal amount of the inlets 26 are disposed inside the first stage reactor section 14 (e.g., only 1 to 2 inches of the inlets 26 may extend into the first reaction zone 20 when the refractory liner is new or newly refurbished). Such a configuration may reduce the amount of the inlets 26 that are exposed to the potentially damaging conditions of the first reaction zone 20. The inlets 26 may each comprise any element or combination of elements operable to allow the passage of the feedstock 12 to the first reaction zone 20, including tubes and apertures. However, as depicted in FIG. 3, in some embodiments, each inlet 26 can include a nozzle 28 operable to at least partially mix the feedstock 12 with an oxidant. For example, each nozzle 28 may be operable to at least partially mix the feedstock 12 with oxygen as the feedstock 12 is provided to the first reaction zone 20. Additionally, each nozzle 28 may be operable to at least partially atomize the feedstock 12 and mix the atomized feedstock 12 with oxygen to enable the rapid conversion of the feedstock 12 into one or more gaseous products within the first reaction zone 20.

In certain embodiments, the inlets 26 are configured to discharge the feedstock 12 towards the center of the first reaction zone 20; where the center of the first reaction zone 20 is the mid-point of a straight line extending between the generally opposing inlets 26. In other embodiments, one or both of the inlets 26 has a skewed orientation so as to discharge the feedstock 12 towards a point that is horizontally and/or vertically offset from the center of the first reaction zone 20. This skewed orientation of the generally opposing inlets 26 can facilitate a swirling motion in the first reaction zone 20. When the inlets 26 are skewed from the center of the first reaction zone 20, the angle at which the feedstock 12 is discharged into the first reaction zone 20 can generally be in the range of from about 1 to about 7 degrees off center.

Referring again to FIGS. 2-4, in some embodiments, the reactor system 10 may include secondary inlets 56 in addition to the inlets 26 discussed above. The secondary inlets 56 may include methane burners 56*a* operable to mix methane and oxygen for introduction into the reactor system 10 to control the temperature and/or pressure of the reactor system 10. The methane burners 56*a* may be positioned away from the inlets 26 and inlet projections 24, such as on the main body 22, to ensure even mixing and heating. The methane burners 56*a* may be oriented to facilitate a swirling gas motion in the first reaction zone 20 to effectively lengthen the gas flow path, increase gas residence time, and provide generally uniform heat transfer from the gases to the first inner surfaces 18. In some embodiments, the reactor system 10 may include a single methane burner 56*a* operable to heat the first reaction zone 20 to desired temperatures due the upright configuration of the reactor system 10.

The secondary inlets 56 may also include char injectors 56*b* operable to introduce dry char into the first reaction zone 20 to facilitate reaction of the feedstock 12, as is discussed in more detail below. The char injectors 56*b* may be operable to introduce the dry char generally toward the center of the first reaction zone 20 to thereby increase carbon conversion. At least some of the char injectors 56*b* may be disposed towards the top of the first stage reactor section 14 to further increase carbon conversion. The char injectors 56*b* may also be orientated to create a swirling char motion when introducing char to the first reaction zone 20 to increase carbon conversion and provide for more uniform temperature distribution within the first reaction zone 20.

Referring again to FIG. 1, the second stage reactor section 16 is positioned generally above the first stage reactor section 14 and presents a plurality of second inner surfaces 30 defining a second reaction zone 32 in which products produced in the first reaction zone 20 may be further reacted. The second stage reactor section 16 may include a secondary feedstock inlet 62 operable to provide feedstock 12 to the second reaction zone 32 for reaction therein. As discussed below, the second stage reactor section 16 may be integral or discrete with the first stage reactor section 14.

In some embodiments, the reactor system 10 may additionally include a throat section 34 providing fluid communication between the first stage reactor section 14 and the second stage reactor section 16 to allow fluids to flow from the first reaction zone 20 to the second reaction zone 32. The throat section 34 defines an upward flow passageway 36 through which fluids may pass. In some embodiments, the open upward flow area of throat section can be less than about 50 percent, less than about 40 percent, or less than 30 percent of the maximum open upward flow areas provided by the first reaction zone 20 and second reaction zone 32. As utilized herein, "open upward flow area" refers to the open area of a cross section taken perpendicular to the direction of upward fluid flow therethrough.

Referring again to FIGS. 2-4, the reactor system 10 can be comprised of any materials operable to at least temporarily sustain the various temperatures and pressures encountered when gasifying the feedstock 12, as is discussed in more detail below. In some embodiments, the reactor system 10 may comprise a metallic vessel 40 and a refractory material 42 at least partially lining the inside of the metallic vessel 40. The refractory material 42 may thus present at least a portion of the first inner surfaces 18.

The refractory material 42 may comprise any material or combinations of materials operable to at least partially protect the metallic vessel 40 from the heat utilized to gasify the feedstock 12. In some embodiments, the refractory material 42 may comprise a plurality of bricks 44 that at least partially line the inside of the metallic vessel 40, as is illustrated in FIGS. 2-4. To protect the metallic vessel 40, the refractory material 42 can be adapted to withstand temperatures greater than 2000° F. for at least 30 days without substantial deformation and degradation.

As depicted in FIG. 3, the refractory material 42 can further include a ceramic fiber sheet 46 disposed between at least a portion of the bricks 44 and the metallic vessel 40 to provide additional protection to the metallic vessel 40 in the event that the integrity of the bricks 44 becomes compromised. However, as the refractory material 42 may be easily and partially replaced due to the upright configuration of the reactor system 10, in some embodiments the ceramic fiber sheet 46 and other backup liners may be eliminated from the reactor system 10 to reduce design complexity and maximize the volume of the first reaction zone 20.

In some embodiments, the reactor system 10 may additionally include a water-cooled membrane wall panel disposed between the refractory material 42 and metallic vessel 40. The membrane wall panel may include various water inlet and outlet lines to allow water to be re-circulated through the membrane wall panel to cool portions of the reactor system 10. Additionally or alternatively, the reactor system 10 may include a plurality of water-cooled staves positioned in proximity to the center of the first stage reaction section 14 and behind the refractory material 42 to eliminate the need for backup materials such as the ceramic fiber sheet 46 and to thus increase the volume of the first reaction zone 20. Utilization of the water-cooled membrane and/or staves can improve the life of the refractory material 42 by increasing the thermal gradient through the material 42 and limiting the depth of molten slag penetration and associated material 42 spalling.

As shown in FIG. 2, the first stage reactor section 14 may present a floor 48 with a drain or tap hole 50 disposed therein to allow reacted and unreacted feedstock 12, such as slag, to flow from the first stage reactor section 14 to a containment area, such as a quench section 52. The quench section 52 may be partially filled with water to quench and freeze molten slag that falls from the drain 50. To facilitate the flow of slag to the drain 50, the floor 48 can be sloped towards the drain 50. The lower surfaces of the inlet projections 24 may also be sloped to facilitate the flow of slag to the floor 48. The generally upright configuration of the reactor system 10 enables the drain 50 to be positioned on the floor 48 of the first stage reactor section 14 and away from supports for the refractory material 42 and/or inlet projections 24. Such a configuration prevents the supports from being damaged by quench water that may back up through the drain 50 from the quench section 52.

As shown in FIG. 2, the reactor system 10 may also include various sensors 54 for sensing conditions within and around the reactor system 10. For example, the reactor system 10 may include various temperature and pressure sensors 54, such as retractable thermocouples, differential pressure transmitters, optical pyrometer transmitters, combinations thereof, and the like, disposed on and within the main body 22, inlet projections 24, and/or inlets 26 to acquire data regarding the reactor system 10 and the gasification process. The various sensors 54 may also include television transmitters to enable technicians to acquire images of the inside of the reactor system 10 while the reactor system 10 is functioning. The sensors 54 may be positioned on the inlet projections 24 to space the sensors 54 from the center of the first reaction zone 20 to extend the life and functionality of the sensors 54.

As shown in FIG. 3, the reactor system 10 may also include various inspection pathways 58 to enable operators to view, monitor, and/or sense conditions within the reactor system 10. For example, as illustrated in FIG. 3, some of the inspection pathways 58 may enable operators to view the condition of the inlets 26 and refractory material 42 utilizing a horoscope or other similar equipment. The reactor system 10 may also include one or more access manways 60 to enable operators to easily access internal portions of the reactor system 10, such as the drain 50 and refractory material 42. The generally upright configuration of the reactor system 10 enables the manways 60 to be more easily placed at important reactor system 10 locations, such as in proximity to the drain 50, secondary inlets 56, and the like, to facilitate maintenance and repair.

In some embodiments, the reactor system 10 may comprise a monolithic gasification reactor that presents both the first stage reactor section 14 and the second stage reactor section 16 in a monolithic configuration. Thus, the first stage reactor section 14 and second stage reactor section 16 may integrally formed of the same materials, such as the metallic vessel 40 and refractory material 42 discussed above as opposed to being formed by multiple vessels connected by various flow conduits.

In operation, the feedstock 12 is provided by the inlets 26 to the first reaction zone 20 and at least partially combusted therein. The combustion of the feedstock 12 in first reaction zone 20 produces a first reaction product. In embodiments where the reactor system 10 includes the second stage reactor section 16, the first reaction product may pass from the first reaction zone 20 to the second reaction zone 32 for further reacting within the second reaction zone 32 to provide a second reaction product. The first reaction product may pass through the throat section 34 to flow from the first reaction zone 20 to the second reaction zone 32. An additional quantity of feedstock 12 can be introduced into the second reaction zone 32 for at least partial combustion therein.

In some embodiments, the feedstock 12 can comprise coal and/or petroleum coke. The feedstock 12 can further comprise water and other fluids to generate a coal and/or petroleum coke slurry for more ready flow and combustion. Where the feedstock 12 comprises coal and/or petroleum coke, the first reaction product may comprise steam, char, and gaseous combustion products such as hydrogen, carbon monoxide, and carbon dioxide. The second reaction product may similarly comprise steam, char, and gaseous combustion products such as hydrogen, carbon monoxide, and carbon dioxide when the feedstock 12 comprises coal and/or petroleum coke. The various reaction products may also include slag, as discussed in more detail below.

The first reaction product can comprise an overhead portion and underflow portion. For example, where the first reaction product comprises steam, char, and gaseous combustion products, the overhead portion of the first reaction product may comprise steam and the gaseous combustion products while the underflow portion of the first reaction product may comprise slag. "Slag," as utilized herein, refers to the mineral matter from the feedstock 12, along with any added residual fluxing agent, that remains after the gasification reactions that occur within the first reaction zone 20 and/or second reaction zone 32.

The overhead portion of the first reaction product may be introduced into the second reaction zone 32, such as by passing through the throat section 34, and the underflow portion of the first reaction product may be removed or otherwise pass from the bottom of the first reaction zone 20. For example, the underflow portion, including slag, may pass through the drain 50 and into the quench section 52.

The maximum superficial velocity of the overhead portion of the first reaction product in the throat section 34 can be at least about 30 feet per second, in the range of from about 35 to about 75 feet per second, or 40 to 50 feet per second. The maximum velocity of the overhead portion in the second reaction zone 32 can be in the range of from about 10 to about 20 feet per second. However, as should be appreciated, the superficial velocity of the overhead portion may vary depending on the conditions within the first reaction zone 20 and second reaction zone 32.

The reaction of the feedstock 12 within the first reaction zone 20 and/or second reaction zone 32 may also produce char. "Char," as utilized herein, refers to unburned carbon and ash particles that remain entrained within the first reaction zone 20 and/or second reaction zone 32 after production of the various reaction products. The char produced by reaction of the feedstock 12 may be removed and recycled to increase carbon conversion. For example, char may be recycled through the secondary inlets **56*b* for injection into the first reaction zone 20** as discussed above.

The combustion of the feedstock 12 within the first reaction zone 20 may be carried out at any temperature suitable to generate the first reaction product from the feedstock 12. For example, in embodiments where the feedstock 12 comprises coal and/or petroleum coke, the combustion of the feedstock 12 within the first reaction zone 20 may be carried out at a maximum temperature of at least about 2,000° F., in the range of from about 2,200 to about 3,500° F., or 2,400 to 3,000° F. In embodiments where the reactor system 10 includes the second stage reactor section 16, the reacting performed within the second reaction zone 32 can be an endothermic reaction carried out at an average temperature that is at least about 200° F., in the range of from about 400 to about 1,500° F., or 500 to 1,000° F. less than the maximum temperature of the combustion performed within the first reaction zone 20. The average temperature of the endothermic reaction is defined by the average temperature along the central vertical axis of the second reaction zone 32. To facilitate reaction and generation of the reaction products, the first reaction zone 20 and second reaction zone 32 may each be maintained at a pressure of at least about 350 psig, the range of from about 350 to about 1,400 psig, or 400 to 800 psig.

Removal of slag and other byproducts of the gasification of the feedstock 12 may be facilitated by the upright configuration of the reactor system 10. For instance, by limiting the use of first inner surfaces 18 that present an upwardly facing orientation, falling slag is readily forced towards the drain 50 due to the slope of the floor 48. Easy removal of slag and other undesirable gasification byproducts from the reactor system 10 may increase the volume of the reaction zones 20, 32, and associated mass throughput, by preventing the accumulation of slag.

The first and second reaction products may be recovered from the various reaction zones 20, 32 for further use and/or processing by conventional systems, such as the system disclosed in U.S. Pat. No. 4,872,886, which is incorporated by reference above. In some embodiments where the feedstock 12 comprises coal, the reactor system 10 may have a coal gasification capacity in the range of about 25 to about 200 pounds per hour per cubic foot.

Various dimensions and characteristics of one exemplary embodiment of the reactor system 10 are provided below in Table. 1:

TABLE 1

| | |
|---|---|
| Design Pressure (PSIG) | 800 |
| Design Temperature (° F.) | 650 |
| Coal Throughput (tons/day) | 3,000 |
| Petcoke Throughput (tons/day) | 2,400 |
| First Stage 14 Outside Distance | 33'-7" |
| First Stage 14 Inside Diameter | 8'-0" |
| Second Stage 16 Inside Diameter | 16'-9" |
| First Reaction Zone 20 Volume ($ft^3$) | 4,582 |
| Scaled MW Capacity | 250 |
| Inlet 26 to Inlet 26 Distance | 32'-5" |
| Inlet 26 to Vertical Centerline Distance | 16'-2 ½" |

The configuration of the reactor system 10 may enable the reactor system 10 to be more easily assembled and installed. For example, the walls of the metallic vessel 40 may be thinner than those provided by conventional gasification reactors due to the upright configuration of the reactor system 10. The use of thinner vessel walls allows less material to be purchased to fabricate the metallic vessel 40 and requires fewer man hours to fabricate the metallic vessel 40. Less piling, support steel, and concrete may also be required to support to the metallic vessel 40 due to the use of thinner vessel walls. The simplified configuration of the reactor system 10 may also enable internal vessel stresses to be more equally distributed across the metallic vessel 40 and reduce the number of hot spots that may form on the metallic vessel 40.

Further, the various dimensions presented by embodiments of the refractory material 42 may present fewer shapes for coupling with the metallic vessel 40. Thus, in embodiments where the bricks 44 are utilized, the bricks 44 may more easily be arranged to line the various portions of the metallic vessel 40 without requiring a significant number of overhead refractory arches. The refractory material 42 may also be more easily supported within the metallic vessel 40 due to the simplified configuration of the reactor system 10. For example, refractory supports may be easily added and repositioned to allow portions of the refractory material 40 to be selectively replaced. Further, due to the upright configuration of the reactor system 10, the refractory material 42 may be positioned farther away from the center of the first reaction zone 20 than in conventional designs, thereby further extending the life of the refractory material 42. The simplified shape of the reactor system 10 additionally enables the reactor system 10 to be more easily tested with non-destructive testing instruments, such as infrared thermal scans, than conventional designs.

Figure 6:
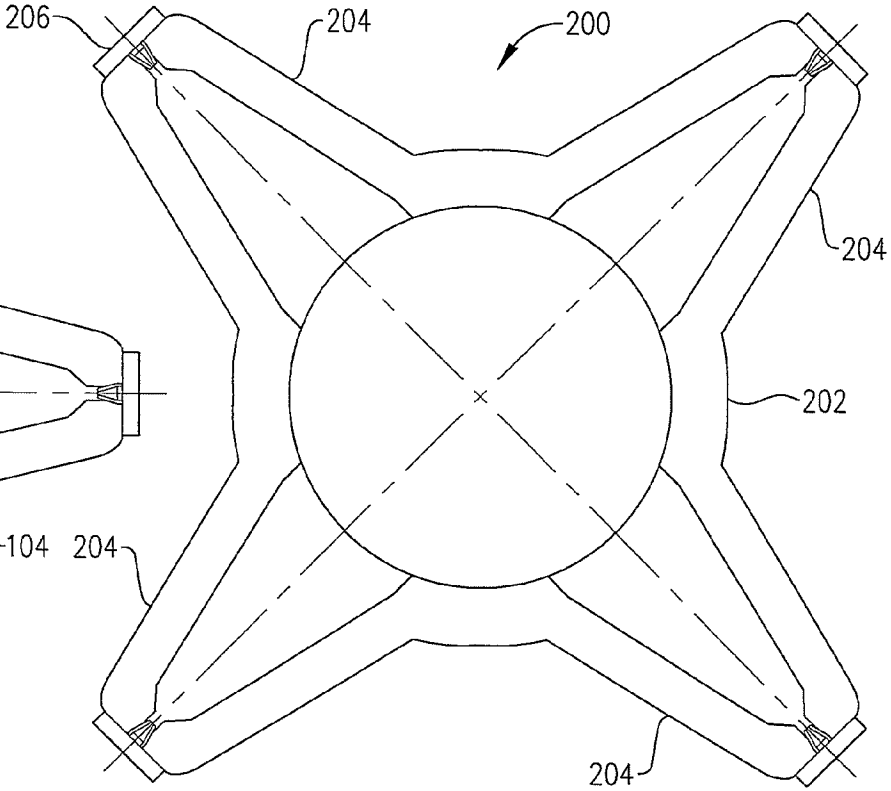
FIG. 6 is a cross section of an alternative gasification reactor employing four inlet projections.
Figure 5:
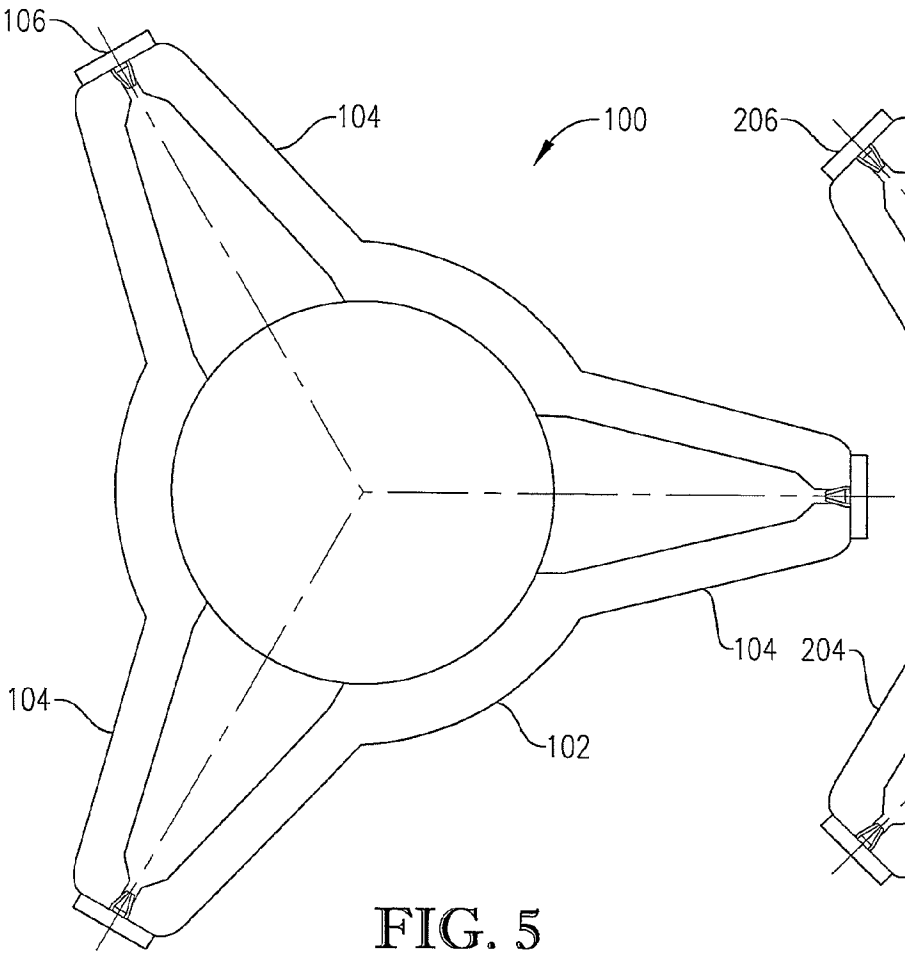
FIG. 5 is a cross section of an alternative gasification reactor employing three inlet projections.

FIGS. 5 and 6 schematically illustrate the first stage reactor sections of two reactor systems 100 and 200 configured in accordance with alternative embodiments of the present invention. As depicted in FIG. 5, the first stage reactor section of reactor system 100 generally comprises a main body 102 and three inlet projections 104, with each of the inlet projections 104 having an inlet 106 positioned at the distal end thereof. As depicted in FIG. 6, the first stage reactor section of reactor system 200 generally comprises a main body 202 and four inlet projections 204, with each of the inlet projections 204 having an inlet 206 positioned at the distal end thereof.

In one embodiment, inlets 106 and 206 of reactor systems 100 and 200 can be oriented to discharge the feedstock toward the center of the first stage reaction zone. Alternatively, the inlets 106 and 206 of reactor systems 100 and 200 can have a skewed orientation so as to discharge the feedstock toward a location that is horizontally and/or vertically offset from the center of the first stage reaction zone, thereby facilitating a swirling motion in the first stage reaction zone.

Other than having more than two inlet projections, the reactor systems 100 and 200 of FIGS. 5 and 6, respectively, can be configured and can function in substantially the same manner as reactor system 10, which is described in detail above with reference to FIGS. 2-4.

As used herein, the terms "a," "an," "the," and "said" means one or more.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

As used herein, the term "char" refers to unburned carbon and ash particles that remain entrained within a gasification reaction zone after production of the various reaction products.

As used herein, the terms "comprising," "comprises," and "comprise" are open-ended transition terms used to transition from a subject recited before the term to one or elements recited after the term, where the element or elements listed after the transition term are not necessarily the only elements that make up of the subject.

As used herein, the terms "containing," "contains," and "contain" have the same open-ended meaning as "comprising," "comprises," and "comprise," provided below.

As used herein, the term "downwardly facing orientation" refers to surfaces having a normal vector that extends at an angle greater than 45 degrees below horizontal.

As used herein, the terms "having," "has," and "have" have the same open-ended meaning as "comprising," "comprises," and "comprise," provided above.

As used herein, the terms "including," "includes," and "include" have the same open-ended meaning as "comprising," "comprises," and "comprise," provided above.

As used herein, the term "open upward flow area" refers to the area of a cross section taken perpendicular to the upward direction of fluid flow therethrough.

As used herein, the term "slag" refers to the mineral matter from a gasification feedstock, along with any added residual fluxing agent, that remains after the gasification reactions that occur within a gasification reaction zone.

As used herein, the term "upright orientation" refers to surface orientations that have a slope of less than 45 degrees from the vertical.

As used herein, the term "upwardly facing orientation" refers to surfaces having a normal vector that extends at angle greater than 45 degrees above horizontal.

As used herein, the term "vertically elongated" refers to a configuration where the maximum vertical dimension is greater than the maximum horizontal dimension.

What is claimed is:

1. A method for gasifying a carbonaceous feedstock, said method comprising:

(a) at least partly combusting said feedstock in a first stage reactor section defining a first reaction zone to thereby produce a first reaction product, wherein said first reaction zone is cooperatively defined by a plurality of inner surfaces, wherein at least about 50 percent of the total area of said inner surfaces has an upright orientation, wherein less than about 10 percent of the total area of said inner surfaces has a normal vector extending at an angle greater than 45 degrees above horizontal, thereby facilitating the removal of slag and other gasification byproducts within the first stage reactor section, wherein said first stage reactor section comprises a main body and at least two inlet projections extending outwardly from said main body, wherein said main body and said inlet projections cooperatively define said first reaction zone, wherein less than about 50 percent of the total volume of said first reaction zone is defined within said inlet projections, wherein the maximum outside diameter of said main body is at least 25 percent greater than the maximum outside diameter of said inlet projections, thereby increasing the maximum internal pressure that can be withstood by said reactor system;

(b) further reacting at least a portion of said first reaction product in a second stage reactor section defining a second reaction zone that is located generally above said first reaction zone to thereby produce a second reaction product.

2. The method of claim 1, wherein less than about 10 percent of the total area of said inner surfaces has a downwardly facing orientation.

3. The method of claim 1, wherein said feedstock is introduced into said first reaction zone via inlets located proximate the outer ends of each of said inlet projections.

4. The method of claim 1, wherein said first stage reactor section comprises a pair of said inlet projections extending from generally opposite sides of said main body, wherein the maximum inside diameter of said main body is at least about 30 percent of the horizontal distance between said inlets of said pair of inlet projections.

5. The method of claim 1, wherein said combusting of step (a) is carried out at a maximum temperature of at least about 2,000° F.

6. The method of claim 5, wherein said reacting of step (b) is carried out at an average temperature that is at least about 200° F. less than said maximum temperature of said combusting.

7. The method of claim 1, wherein said first and second reaction zones are maintained at a pressure of at least about 250 psig.

8. The method of claim 1, wherein said reacting of step (b) is endothermic.

9. The method of claim 1, wherein said feedstock comprises coal and/or petroleum coke.

10. The method of claim 1, further comprising introducing an additional quantity of said feedstock into said second reaction zone.

11. The method of claim 1, wherein said first reaction product comprises steam, char, and gaseous combustion products comprising hydrogen, carbon monoxide, and carbon dioxide.

12. The method of claim 1, wherein said first reaction product comprises an overhead portion and an underflow portion, wherein said overhead portion is introduced into said second reaction zone, wherein said underflow portion is removed from the bottom of said first reaction zone.

13. The method of claim 12, further comprising passing said overhead portion through a throat located between said first and second reaction zones, wherein the maximum superficial velocity of said overhead portion in said throat is at least about 30 feet per second.

* * * * *